US010799955B2

(12) United States Patent
Yoon et al.

(10) Patent No.: US 10,799,955 B2
(45) Date of Patent: Oct. 13, 2020

(54) METHOD OF MANUFACTURING METAL POWDERS AND APPARATUS FOR MANUFACTURING METAL POWDERS REALIZING THE SAME

(71) Applicant: KOREA UNIVERSITY RESEARCH AND BUSINESS FOUNDATION, Seoul (KR)

(72) Inventors: Woo Young Yoon, Seoul (KR); Jun Kyu Lee, Seoul (KR); Sung Man Cho, Gwacheon-si (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 287 days.

(21) Appl. No.: 15/823,902

(22) Filed: Nov. 28, 2017

(65) Prior Publication Data

US 2018/0079008 A1 Mar. 22, 2018

Related U.S. Application Data

(62) Division of application No. 14/659,996, filed on Mar. 17, 2015, now Pat. No. 9,855,605.

(30) Foreign Application Priority Data

Mar. 20, 2014 (KR) ..... 10-2014-0032976

(51) Int. Cl.
*B22F 9/06* (2006.01)
*F27B 7/20* (2006.01)

(52) U.S. Cl.
CPC ..... *B22F 9/06* (2013.01); *F27B 7/2083* (2013.01); *B22F 2009/065* (2013.01)

(58) Field of Classification Search
None
See application file for complete search history.

(56) References Cited

U.S. PATENT DOCUMENTS

| | | | | |
|---|---|---|---|---|
| 5,618,580 | A * | 4/1997 | Oshima | B01J 12/02 118/715 |
| 10,005,062 | B2 * | 6/2018 | Hong | B01J 19/20 |
| 10,201,797 | B2 * | 2/2019 | Hong | B01F 7/008 |
| 10,335,755 | B1 * | 7/2019 | Shin | B01J 3/02 |
| 2006/0062702 | A1 * | 3/2006 | Hagemeister | B01F 7/00908 422/131 |
| 2007/0292686 | A1 * | 12/2007 | Nagasawa | B82Y 30/00 428/402 |

(Continued)

*Primary Examiner* — George Wyszomierski
(74) *Attorney, Agent, or Firm* — Kile Park Reed & Houtteman PLLC

(57) ABSTRACT

In a method of manufacturing metal powders in a continuous type, metal is heated at a temperature greater than a melting point to form a liquid phase metal, and the liquid phase metal and an emulsion carrier, which is emulsified without reacting with the liquid phase metal, are supplied into a container, and the liquid phase metal and the emulsion carrier are emulsified through Taylor flow to form an emulsion solution. The emulsion solution is discharged from the container, and then, the emulsion solution is cooled at a temperature smaller than the melting point to selectively solidifying the liquid phase metal in the emulsion solution to form the metal powders.

4 Claims, 2 Drawing Sheets

(56) References Cited

U.S. PATENT DOCUMENTS

2010/0296982 A1* 11/2010 Hong ..... B01D 9/0036
422/187
2010/0329947 A1* 12/2010 Fischel ..... B01J 10/007
422/198

* cited by examiner

METHOD OF MANUFACTURING METAL POWDERS AND APPARATUS FOR MANUFACTURING METAL POWDERS REALIZING THE SAME

CROSS REFERENCE TO RELATED APPLICATIONS

This application is a divisional application of U.S. patent application Ser. No. 14/659,996, filed on Mar. 17, 2015 (currently pending), the disclosure of which is herein incorporated by reference in its entirety. The U.S. patent application Ser. No. 14/659,996 claims priority to Korean Application No. 10-2014-0032976 filed on Mar. 20, 2014, the entire contents of which are incorporated herein by reference.

BACKGROUND

1. Field of Disclosure

The present invention relates to a method of manufacturing metal powders and an apparatus for manufacturing metal powders realizing the same. More specifically, the present invention relates to a method of manufacturing metal powders by solidifying liquid phase metal and an apparatus for manufacturing metal powders realizing the same.

2. Description of Related Technology

Minute metal powders are manufactured in various methods. For example, a plasma method using a plasma, a gas spray method, a melt spinning method, etc., have been widely used.

However, the above-mentioned methods require a relatively expensive apparatus for performing processes, and the processes are complex, and thus, the methods have disadvantageous demerits in a temporal side. For example, the gas spray method crashes a liquid phase metal using a second fluid (a gas or a liquid) or collides to a solid plate at a high speed. The gas spray method includes processes, in which an impact energy of a spray gas is transmitted to a molten metal ejected through a nozzle, and thus, the molten metal is crashed to form powders. Here, the impact energy should be efficiently transmitted to the molten metal. However, the efficient transmission of the impact energy is hard, and thus, minute powders or uniform sized powders are not easy to manufacture. Thus, in the gas spray method, when the metal powders are manufactured in a mass production, yield is low in manufacturing minute metal powders.

Meanwhile, sizes of the metal powders determine mechanical and physical characteristics. Thus, process variables for forming metal powders of minute sizes are required to be precisely controlled. However, the gas spray method has a demerit, in which the process variables are uncontrollable.

In order to compensate the above-mentioned method of manufacturing the metal powders, an invention of a mixer settler method and a manufacturing apparatus for realizing the same is disclosed on Korean Patent Number 10-0344356.

However, although the mixer settler method has a merit, in which variables are easily controlled and processes are simpler compared with the conventional gas spray method, the mixer settler method has several problems. The mixer settler method is basically a process corresponding to a batch type. Thus, in a mass production using the mixer settler method, sizes and distributions of powders may be changed by various process variables. Also, a metal molten in an organic solvent is overflowed to be transmitted to a settler part in a step of emulsion, and thus, a control of a time for the above and a control of an impeller rotation speed are hard to adjust.

SUMMARY

The present invention is directed to a method of manufacturing metal powders, which is capable of stably controlling process variables.

The present invention is directed to an apparatus for manufacturing metal powders realizing the above-mentioned method of manufacturing the metal powders.

According to a method of manufacturing metal powders according to one embodiment of the present invention, metal is heated at a temperature greater than a melting point to form a liquid phase metal, and the liquid phase metal and an emulsion carrier, which is emulsified without reacting with the liquid phase metal, are supplied into a container, and the liquid phase metal and the emulsion carrier are emulsified through Taylor flow to form an emulsion solution. The emulsion solution is discharged from the container, and then, the emulsion solution is cooled at a temperature smaller than the melting point to selectively solidifying the liquid phase metal in the emulsion solution to form the metal powders.

In one embodiment of the present invention, the emulsion solution may be formed by controlling a rotation number of the tumbling barrel mounted in the container to control a mean diameter of the metal powders.

In one embodiment of the present invention, when the melting point is smaller than or equal to about 300° C., the emulsion carrier may include an inorganic mineral oil, and when the melting point is greater than about 300° C., the emulsion carrier may include a metal salt.

In one embodiment of the present invention, the metal powders may be additionally cleaned using an organic solvent.

In one embodiment of the present invention, supplying the liquid phase metal and an emulsion carrier into the container is controlled such that an volume ratio of the liquid phase metal is equal or more than 30% with respect to the overall volume of the liquid phase metal and the emulsion carrier.

In one embodiment of the present invention, supplying the liquid phase metal and an emulsion carrier into the container further comprises the supplying a surface modifier in the container.

An apparatus for manufacturing metal powders according to one embodiment of the present invention includes an emulsion part including a container forming an emulsion solution by emulsifying a liquid phase metal and an emulsion carrier, which is emulsified without reacting with the liquid phase metal, through the Taylor flow, a supply part disposed on one side of the container and independently supplying the liquid phase metal and the emulsion carrier into the container, a discharge part disposed on another side of the container and discharging the emulsion solution from the container, and a separate part coupled with the discharge part and cooling the emulsion solution at a temperature smaller than the melting point of the liquid phase metal to selectively solidify the liquid phase metal in the emulsion solution to separate the metal powders from the emulsion solution.

In one embodiment of the present invention, the emulsion part may be disposed inside the container, and may include a tumbling barrel configured to rotate to apply a centrifugal force and Coriolis force to the liquid phase metal and the emulsion carrier. Here, the emulsion part may control an interval between the container and the tumbling barrel, a rotation speed of the tumbling barrel, or a volume ratio of the liquid phase metal and the emulsion carrier to control a mean diameter of the metal powders.

In one embodiment of the present invention, when the melting point is smaller than or equal to about 300° C., the emulsion carrier may include an inorganic mineral oil, and when the melting point is greater than about 300° C., the emulsion carrier may include a metal salt.

In one embodiment of the present invention, the metal powders may be controlled to have a mean diameter of about 1 to 100 μm.

According to the method of manufacturing the metal powders and the apparatus for manufacturing the same, the molten metal and the emulsion carrier are uniformly mixed through Taylor fluid flow to form an emulsion solution, and the emulsion solution is cooled to solidify the molten metal, and thus, metal powders having a uniform size may be manufactured in a mass production. Also, an interval between a container and a tumbling barrel, a rotation speed of the tumbling barrel, and a volume ratio of a mixture of the molten metal and the emulsion carrier, etc., are controlled to control a mean diameter of the metal powders.

Compared with a conventional batch type, embodiments of the present invention are continuous processes, and thus, may have effects such as mass production caused by decreased processes, const reduction, etc. Also, since the Taylor fluid flow is used, a material transfer speed and an agitation intensity are excellent, and thus, a cycle time may be decreased.

BRIEF DESCRIPTION OF THE DRAWINGS

The above and other features and advantages will become more apparent by describing exemplary embodiments thereof with reference to the accompanying drawings, in which.

DETAILED DESCRIPTION

Figure 1:
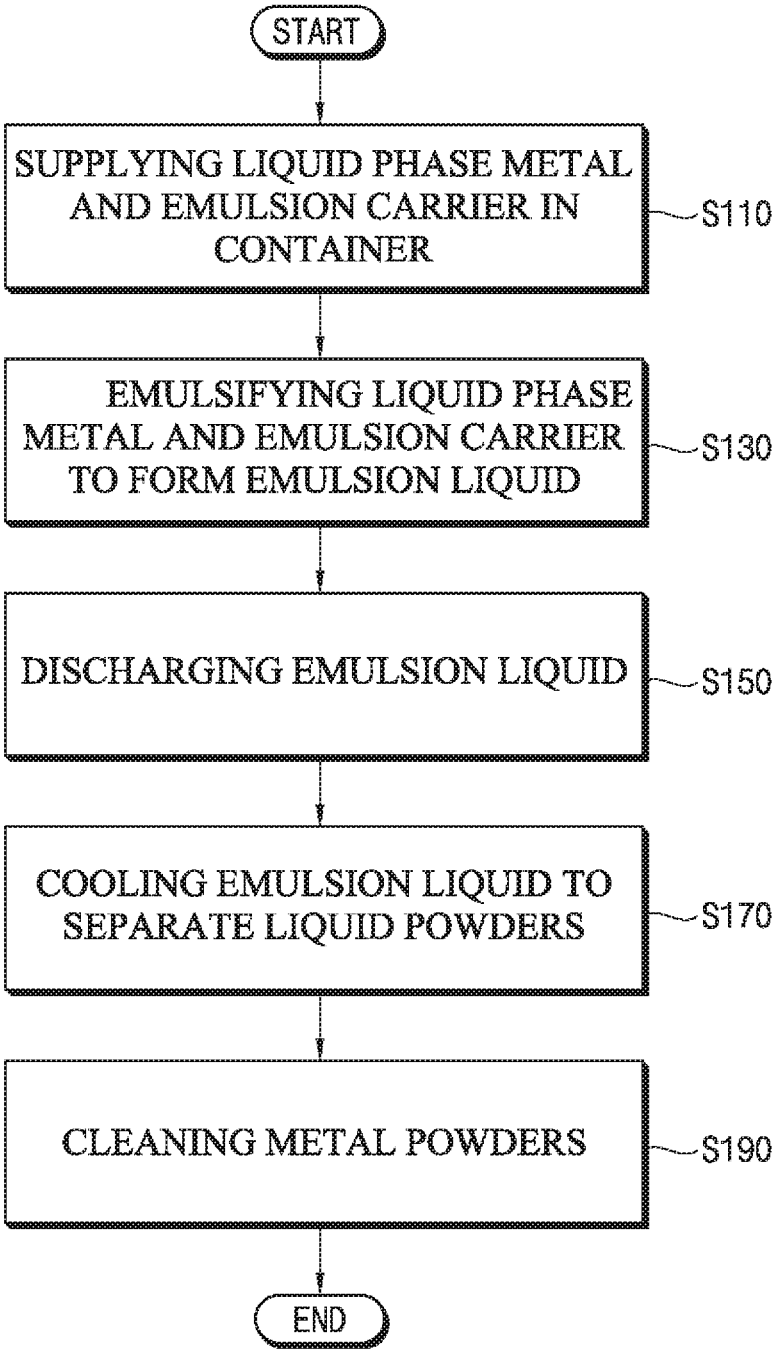
FIG. 1 is a flow chart illustrating a method of manufacturing metal powders according to one embodiment of the present invention.

Hereinafter, embodiments of the invention will be explained in detail with reference to the accompanying drawings. While the invention is susceptible to various changes have to be introduced in various forms and may have a bar, and the specific embodiments illustrated in the drawings shall be explained in detail in the text. However, it is disclosed in a particular form of the present invention is not intended to limit, the spirit and technical scope of the present invention includes all modifications, equivalents and substitutes should be understood to include. Accompanying drawings, the dimensions of the structure of the present invention larger than actual in order to clarity the group shown in the drawings.

The terms such as first, second, etc., can be used in describing various elements, but the above elements by the above terms should not be limited. The above terms are one element from the other used only to distinguish. For example, in the present invention without departing from the scope of the first component to the second component may be named similarly, the second component to the first component also can be named.

Use of a term in the present application for the purpose of describing particular embodiments only be used, and are not intended to limit the invention. Yield a clearly different meaning in the context of the expression of the plural, unless expressed and the like. In the present application, "including" or "having" and the like is intended to set forth features, integers, steps, operations, elements, parts or combinations not possible specify the presence of one or more other features, integers, steps, operations, elements, parts or combinations of those present in or added are not intended to preclude the possibility must be.

Unless otherwise defined, including technical and scientific terms used herein, all terms are to the present invention is not skilled in the art as commonly understood by one party the same meaning. The commonly used terms such as those defined in advance in the context of the related art having the meanings and shall be construed to have a meaning consistent and, in this application, unless otherwise defined explicitly, ideal or excessively formal meaning to be construed not.

Method of Manufacturing Metal Powders

FIG. 1 is a flow chart illustrating a method of manufacturing metal powders according to one embodiment of the present invention.

Referring to FIG. 1, according to the method of manufacturing the metal powders according to the embodiment of the present invention, an emulsion carrier, which is emulsified without reaction between a liquid phase metal and the liquid phase metal, is introduced into a container (step S110). The liquid phase metal, for example, is heated at a temperature greater than a melting point of a metal to have a liquid state. The liquid phase metal, for example, may include lithium.

The emulsion carrier is a material which does not react with the liquid phase metal although being contacted with the liquid phase metal. The emulsion carrier may maintain the liquid state at a temperature greater than or equal to a melting point of the metal and a temperature smaller than or equal to the melting point of the metal. That is, the emulsion carrier requires two conditions. In the first condition, the emulsion carrier includes materials which have a boiling point greater than or equal to the melting point of the molten metal, and maintain a liquid state at a solidifying point of the molten metal. Also, in the second condition, the emulsion carrier does not react with the molten metal.

For example, when the molten metal corresponds to a low melting point metal such as lithium (Li), tin(Sn), etc., an inorganic oil (for example, silicon oil) having a melting point smaller than or equal to about 300° C. may be used.

Meanwhile, based on kinds of the molten metal, a salt may be used as the emulsion carrier instead of the inorganic mineral oil, and the emulsion carrier may be changed based on the melting point of the metal.

That is, when the molten metal corresponds to a high melting point metal such as aluminum (Al), iron (Fe), etc., and the melting point is greater than about 300° C., for example, a metal salt such as sodium chloride (NaCl), potassium chloride (KCl), or sodium fluoride (NaF), etc., which has a boiling point greater than about 2,000° C., may be used as the emulsion carrier.

In the container, the liquid phase metal and the emulsion carrier are emulsified through Taylor flow, thereby forming an emulsion solution (step S130). Here, the liquid phase metal and the emulsion carrier are mixed with each other to be emulsified. Here, the temperature in the container maintains higher than the melting point of the metal.

Meanwhile, a method using a conventional batch reactor has a problem in which a volume of the molten metal should be maintained smaller than or equal to a predetermined ratio to the emulsion carrier, that is, smaller than or equal to about 10% of an overall volume. Thus, since the batch reactor is a giant mixture type using a turbulent flow, the ratio of the emulsion carrier should be relatively increased in emulsion of micro-sized metal.

However, when the Taylor fluid according to the embodiment of the present invention is used, a material transfer speed which is a variable among variables required for emulsification of the molten metal is greater than or equal to about 3 times of that of the conventional batch reactor, and thus, the ratio of the molten metal may be increased more than or equal to about 30% of the overall volume. As a result, a relative amount of the emulsion carrier is decreased, in contrast, an amount of the molten metal is increased, and thus, efficiency of overall processes may be improved. Also, since a volume ratio of a mixture of the liquid phase metal and the emulsion carrier is adjusted, a mean diameter of metal powders which are subsequently formed.

The molten metal flows along the flow of the Taylor fluid in the container. In particular, the container includes a tumbling barrel inside thereof, and the tumbling barrel rotates, and thus, the fluid including the molten metal and the emulsion carrier flows in a rotation direction.

Here, since the centrifugal force and the Coriolis force are simultaneously applied to the fluid, a force which motivates the fluids adjacent to the tumbling barrel in a direction far from the tumbling barrel is generated. Here, as the rotation speed of the tumbling barrel is increased, the flow of the above-mentioned fluid has a rule along an axis direction of the tumbling barrel, a vortex of an annular pair arrangement having opposite directions to each other is formed. Thus, a revolution per minute (RPM) of the tumbling barrel is controlled, and thus, metal powders of a liquid phase having desired diameters may be formed. Also, since the vortex is formed, the molten metal and the emulsion carrier are emulsified to form an emulsion solution.

For example, in the conventional batch reactor, the size of the metal powders manufactured by agitating in about 8,000 to 30,000 RPM is the diameter of about 10 to 80 μm, however, in the fluid flow using the Taylor flow, about 1,000 to 3,000 RPM is required to form the metal powders having the same diameter of about 10 to 80 μm. That is, in the same RPM condition, the efficiency of the agitation using the Taylor flow is greater than the conventional batch reactor. Thus, when the emulsion solution is formed using the Taylor flow, excellent material transfer speed and agitation efficiency may be obtained. Therefore, manufacturing time is decreased, and thus, yield of the metal power is increased.

Then, the emulsion solution is discharged from the container (step S150). Here, the emulsion solution may be discharged through the discharge part formed under the container.

Then, the emulsion solution is cooled, and the metal powders are separated from the emulsion solution (step S190). Here, the emulsion solution may be cooled at a temperature smaller than the melting point of the molten metal. Thus, the molten metal is solidified to form the metal powders in a powder shape of a solid state.

In the embodiment of the present invention, a surface modifier may be additionally supplied in the container. The surface modifier may modify surfaces of the metal powders. Examples of the surface modifier may include a high polymer or a gas such as carbon dioxide, nitrogen, etc.

In the embodiment of the present invention, a cleaning process in which the metal powders are cleaned may be additionally performed.

In the cleaning process, the metal powders may be collected and cleaned using an organic solvent such as hexane. Thus, the metal powders of more excellent purity may be manufactured. Meanwhile, the organic solvent such as the hexane may be recycled through a filter or a distiller.

Apparatus for Manufacturing Metal Powders

Figure 2:
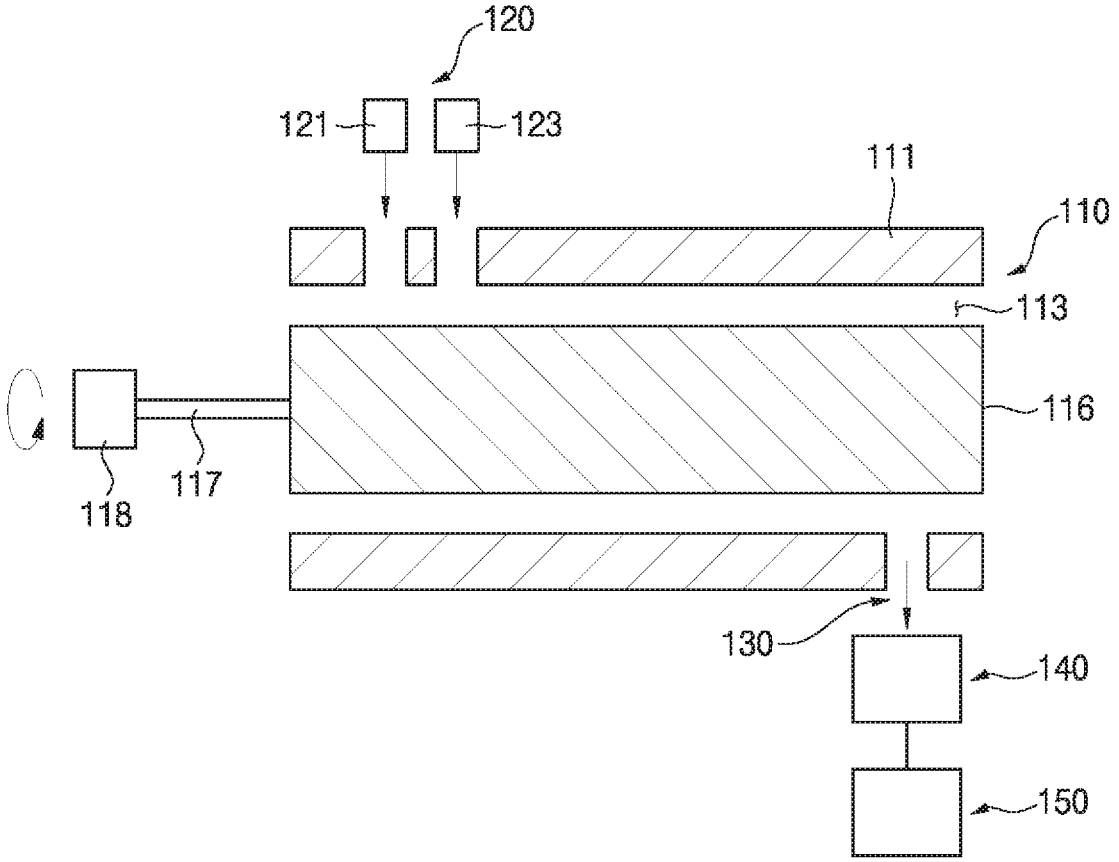
FIG. 2 is a cross-sectional view illustrating an apparatus for manufacturing metal powders according to the embodiment of the present invention.

FIG. 2 is a cross-sectional view illustrating an apparatus for manufacturing metal powders according to the embodiment of the present invention.

Referring to FIGS. 1 and 2, the apparatus for manufacturing the metal powders according to the embodiment of the present invention includes an emulsion part 110, a supply part 120, a discharge part 130, and a separate part 140.

The emulsion part 110 includes the container which forms the emulsion solution by emulsification of the liquid phase metal and the emulsion carrier, which is emulsified without reacting with the liquid phase metal, through the Taylor flow.

The container includes a fixed type cylinder 111 and the tumbling barrel 116 mounted inside the fixed type cylinder 111 and rotating to emulsify the liquid phase metal and the emulsion carrier by the Taylor flow. The liquid phase metal and the emulsion carrier may flow in the Taylor flow in a separate space 113 formed by separation of the fixed type cylinder 111 and the tumbling barrel 116.

The supply part 120 is disposed on one side of the container. The supply part 120 is disposed on the container. The supply part 120 independently supplies the liquid phase metal and the emulsion carrier in the container. That is, the supply part 120 may include a liquid phase metal supply part 121 and an emulsion carrier supply part 123.

The liquid phase metal supply part 121 and the emulsion carrier supply part 123 may be disposed to be separated from each other. Thus, the liquid phase metal and the emulsion carrier are supplied at different positions, and thus, the liquid phase metal and the emulsion carrier may be efficiently emulsified.

Also, the liquid phase metal supply part 121 may include a temperature controller (not shown) which includes a temperature sensor and a heater to control a temperature of the liquid phase metal. Thus, the temperature of the liquid phase metal may be constantly maintained.

The supply part 120, for example, may include a storage tank (not shown), a supply pump (not shown), and a supply line (not shown) bypassing the supply pump (not shown) to connect the storage tank (not shown) to the container.

The discharge part 130 is disposed on another side of the container, that is, the another side corresponding to the one side. The discharge part 130 may be disposed under the container. The discharge part 130 discharges the emulsion solution from the container.

The separate part 140 is coupled with the discharge part 130. The separate part 140 cools the emulsion solution to separate the metal powders from the emulsion solution. That is, since the emulsion solution is cooled, the molten metal in the emulsion solution is selectively solidified to form the metal powders of the solid phase. Here, the emulsion carrier may maintain the liquid state. Also, the metal powders may be easily separated by difference of a specific gravity against the emulsion carrier.

In the embodiment of the present invention, the tumbling barrel 116 may rotate to apply the centrifugal force and the Coriolis force to the liquid phase metal and the emulsion carrier.

That is, since the centrifugal force and the Coriolis force are simultaneously applied to the fluid, a force motivating the fluids adjacent to the tumbling barrel 116 in a direction far from the tumbling barrel 116 is generated. Here, as the rotation speed of the tumbling barrel 116 is increased, the flow of the above-mentioned flow has a predetermined regularity along an axis direction of the tumbling barrel 116 and the vortex of the annular pair arrangement having opposite directions is formed. Thus, the RPM of the tumbling barrel 116 is controlled, and thus, the metal powders of the liquid phase having the desired size may be obtained. Also, since the vortex is formed, the molten metal and the emulsion carrier are emulsified to form the emulsion solution.

For example, in the conventional batch reactor, the size of the metal powders manufactured by agitating in about 8,000 to 30,000 RPM is the diameter of about 10 to 80 μm, however, in the fluid flow using the Taylor flow, about 1,000 to 3,000 RPM is required to form the metal powders having the same diameter of about 10 to 80 μm. That is, in the same RPM condition, the efficiency of the agitation using the Taylor flow is greater than the conventional batch reactor. Thus, when the emulsion solution is formed using the Taylor flow, excellent material transfer speed and agitation efficiency may be obtained. Therefore, manufacturing time is decreased, and thus, yield of the metal power is increased.

Also, the tumbling barrel 116 is included to have various diameters. Thus, an interval between the tumbling barrel 116 and the fixed type cylinder 111 is controlled to obtain the metal powders having the desired mean diameter. For example, as the interval is decreased, the metal powders having smaller size may be obtained.

The apparatus for manufacturing the metal powders of the continuous type according to the embodiment of the present invention may further include a cleaning part 150. The cleaning part 150 is coupled with the separate part 140. The cleaning part 150 may collect the metal powders to clean the collected metal powders using the organic solvent such as the hexane. Thus, the metal powders of more excellent purity may be manufactured. Meanwhile, the organic solvent such the hexane may be recycled through the filter or the distiller.

Therefore, the interval between the container and the tumbling barrel, the rotation speed of the tumbling barrel, or the volume ratio between the liquid phase metal and the emulsion carrier are properly controlled, and thus, the metal powders having the desired mean diameter may be manufactured. For example, the metal powders may be adjusted to have a mean diameter of about 1 to 100 μm.

According to the method of manufacturing the metal powders and the apparatus for manufacturing the same, the molten metal and the emulsion carrier are uniformly mixed through Taylor fluid flow to form an emulsion solution, and the emulsion solution is cooled to solidify the molten metal, and thus, metal powders having a uniform size may be manufactured in a mass production. Also, an interval between a container and a tumbling barrel, a rotation speed of the tumbling barrel, and a volume ratio of a mixture of the molten metal and the emulsion carrier, etc., are controlled to control a mean diameter of the metal powders.

Compared with a conventional batch type, embodiments of the present invention are continuous processes, and thus, may have effects such as mass production caused by decreased processes, const reduction, etc. Also, since the Taylor fluid flow is used, a material transfer speed and an agitation intensity are excellent, and thus, a cycle time may be decreased.

The foregoing is illustrative of the present teachings and is not to be construed as limiting thereof. Although a few exemplary embodiments have been described, those skilled in the art will readily appreciate from the foregoing that many modifications are possible in the exemplary embodiments without materially departing from the novel teachings and advantages of the present disclosure of invention. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. An apparatus for manufacturing metal powders comprising:

an emulsion part including a container forming an emulsion solution by emulsifying a liquid phase metal and an emulsion carrier, which is emulsified without reacting with the liquid phase metal, through the Taylor flow;

a supply part disposed on one side of the container, and independently supplying the liquid phase metal and the emulsion carrier into the container;

a discharge part disposed on another side of the container, and discharging the emulsion solution from the container; and a separate part coupled with the discharge part, and cooling the emulsion solution at a temperature smaller than the melting point of the liquid phase metal to selectively solidify the liquid phase metal in the emulsion solution to separate the metal powders from the emulsion solution wherein the emulsion part further includes a tumbling barrel being disposed inside the container and being configured to rotate to apply a centrifugal force and Coriolis force to the liquid phase metal and the emulsion carrier.

2. The apparatus for manufacturing the metal powders of claim 1, capable of controlling a mean diameter of the metal powders by controlling an interval between the container and the tumbling barrel, a rotation speed of the tumbling barrel, or a volume ratio of the liquid phase metal and the emulsion carrier.

3. The apparatus for manufacturing the metal powders of claim 1, wherein when the melting point is smaller than or equal to about 300° C., the emulsion carrier comprises an inorganic mineral oil, and when the melting point is greater than about 300° C., the emulsion carrier comprises a metal salt.

4. The apparatus for manufacturing the metal powders of claim 1, wherein the metal powders are controlled to have a mean diameter of about 1 to 100 μm.

* * * * *